US011041336B2

(12) United States Patent
Weber et al.

(10) Patent No.: US 11,041,336 B2
(45) Date of Patent: Jun. 22, 2021

(54) HINGE

(71) Applicant: Hettich-ONI GmbH & Co. KG, Vlotho (DE)

(72) Inventors: Konrad Weber, Ebsdorfergrund (DE); Karsten Filges, Bielefeld (DE); Kai Michael Stuke, Bielefeld (DE); Mark Schneider, Porta Westfalica (DE); Jens Poischbeg, Leopoldshoehe (DE); Alexander Heinz, Osnabrueck (DE)

(73) Assignee: Hettich-ONI GmbH & Co. KG, Vlotho (DE)

( * ) Notice: Subject to any disclaimer, the term of this patent is extended or adjusted under 35 U.S.C. 154(b) by 4 days.

(21) Appl. No.: 16/624,364

(22) PCT Filed: Jun. 13, 2018

(86) PCT No.: PCT/EP2018/065603
§ 371 (c)(1),
(2) Date: Dec. 19, 2019

(87) PCT Pub. No.: WO2019/001956
PCT Pub. Date: Jan. 3, 2019

(65) Prior Publication Data

US 2021/0148151 A1 May 20, 2021

(30) Foreign Application Priority Data

Jun. 29, 2017 (DE) ..... 10 2017 114 477.3

(51) Int. Cl.
*E05F 1/08* (2006.01)
*E05F 5/02* (2006.01)
(Continued)

(52) U.S. Cl.
CPC ..... *E05F 5/02* (2013.01); *E05D 3/142* (2013.01); *E05F 5/006* (2013.01);
(Continued)

(58) Field of Classification Search
CPC ..... E05Y 2900/20; E05Y 2900/202; E05Y 2900/204; E05Y 2900/208; E05Y 2201/20;
(Continued)

(56) References Cited

U.S. PATENT DOCUMENTS 5,029,362 A * 7/1991 Prodan ..... E05D 3/142 16/236
8,205,298 B2 * 6/2012 Lin ..... E05F 5/006 16/287
(Continued)

FOREIGN PATENT DOCUMENTS

CN 103726730 A 4/2014
CN 203640462 U 6/2014
(Continued)

OTHER PUBLICATIONS

Patent Translate of WO2008011955 A1.*
(Continued)

*Primary Examiner* — Chuck Y Mah
(74) *Attorney, Agent, or Firm* — Collard & Roe, P.C.

(57) ABSTRACT

A hinge having a side part which can be fastened to a wall and a hinge part which can be pivoted relative to the side part and to which a door can be fixed, and having a linear damper arranged in the side part with a housing and a piston rod which is pretensioned by a spring in a direction away from the housing.

12 Claims, 10 Drawing Sheets

(51) Int. Cl.
*E05D 3/14* (2006.01)
*E05F 5/00* (2017.01)

(52) U.S. Cl.
CPC ..... *E05Y 2201/21* (2013.01); *E05Y 2201/264* (2013.01); *E05Y 2201/412* (2013.01); *E05Y 2201/424* (2013.01); *E05Y 2900/20* (2013.01)

(58) Field of Classification Search
CPC ..... E05Y 2201/21; E05Y 2201/261; E05F 5/006; E05F 5/02; E05F 5/027; E05D 11/1021; E05D 11/1042; E05D 11/105; E05D 11/1604; E05D 7/04; E05D 7/0407; E05D 7/125; E05D 3/142; Y10T 16/5383; Y10T 16/304; Y10T 16/54029
See application file for complete search history.

(56) References Cited

U.S. PATENT DOCUMENTS 8,561,259 B2 * 10/2013 Liao ..... E05D 3/142 16/54
8,601,644 B1 * 12/2013 Chen ..... E05F 5/006 16/286
9,617,773 B2 * 4/2017 Cooper ..... E05D 3/14
9,739,081 B2 * 8/2017 Stuke ..... E05F 5/006
9,840,864 B2 * 12/2017 Chen ..... E05F 5/10
10,081,975 B2 * 9/2018 Cooper ..... E05F 5/02
10,214,951 B2 * 2/2019 Liang ..... E05F 5/00
2005/0248246 A1 * 11/2005 Ger ..... E05F 5/006 312/334.47
2011/0083299 A1 * 4/2011 Krudener ..... E05D 7/0407 16/319
2013/0239363 A1 * 9/2013 apur ..... E05F 5/006 16/50
2015/0330128 A1 * 11/2015 Ng ..... E05D 7/0407 16/65
2017/0138106 A1 * 5/2017 Stuke ..... E05F 1/14
2018/0171690 A1 * 6/2018 Rodriguez Rodriguez ..... E05D 7/0423
2018/0216385 A1 * 8/2018 Rodriguez Rodriguez ..... E05D 3/142

FOREIGN PATENT DOCUMENTS

DE 2818735 A1 * 11/1979 ..... E05D 5/0276
DE 202006003196 U1 7/2007
DE 202006013356 U1 1/2008
DE 102007031175 B3 10/2008
DE 102011050053 A1 * 11/2012 ..... E05F 5/006
EP 2057337 B1 * 9/2018 ..... E05F 5/006
JP 2010209638 A * 9/2010
SU 741806 A3 * 6/1980 ..... E05D 11/1021
WO 2008011955 A1 1/2008

OTHER PUBLICATIONS

International Search Report of PCT/EP2018/065604, dated Sep. 14, 2018.
German Search Report dated Feb. 28, 2018 (with English translation of relevant parts (issued in the corresponding German application 10 2017 114 473.0)).
International Search Report of PCT/EP2018/065603, dated Sep. 18, 2018.
German Search Report dated Feb. 23, 2018 (with English translation of relevant parts (issued in German application 10 2017 114 477.3 (PCT/EP2018/065603)).

* cited by examiner

HINGE

CROSS REFERENCE TO RELATED APPLICATIONS

This application is the National Stage of PCT/EP2018/065603 filed on Jun. 13, 2018, which claims priority under 35 U.S.C. § 119 of German Application No. 10 2017 114 477.3 filed on Jun. 29, 2017, the disclosures of which are incorporated by reference. The international application under PCT article 21(2) was not published in English.

BACKGROUND OF THE INVENTION

The present invention relates to a hinge having a side part which can be fastened to a wall and a hinge part which can be pivoted relative to the side part and to which a door can be fixed, and having a linear damper arranged in the side part with a housing and a piston rod which is pretensioned by a spring in a direction away from the housing.

DE 20 2006 003 196 U discloses a furniture hinge in which a hinge part is pivotally mounted on a side part by means of a support lever and a guide lever. The guide lever is equipped with an extension arm on which a linear damper with a housing and a piston rod that is displaceable relative to the housing is pivotably mounted. Such a linear damper is well suited for damping a closing movement, but there is the problem that by pivoting the linear damper the required installation space in the side part is large.

SUMMARY OF THE INVENTION

It is therefore the object of the present invention to create a hinge which, in a particularly compact design, allows at least one closing movement to be damped.

This object is solved by a hinge with the features of claim 1.

In the case of the hinge according to the invention, a housing of the linear damper is non-rotatably fixed in the side part and fastened to a holder, wherein the holder is fixed to at least one axis on which a lever for pivoting the hinge part is rotatably mounted. As a result, the axis can be used both to support the hinge part and to fix the linear damper. On the one hand, this leads to a reduction in the number of components, and on the other hand, it allows the linear damper to be fixed in the immediate vicinity of the lever, so that the linear damper requires comparatively little installation space.

The holder can be fixed on two axes or, in an alternative embodiment, the holder can be fixed in a non-rotatable manner via at least one axis and with one body edge of the holder resting against the side part.

The holder preferably has a U-shaped shaped part having two legs with openings in which at least one axis is inserted. Particularly preferably, the at least one axis has a polygonal area which approximately corresponds to at least one opening of a leg of the holder. As a result, the linear damper can be easily mounted by pushing the axis through.

The linear damper preferably comprises a pot-shaped housing, which is integrally designed with the holder. Alternatively, the housing of the linear damper can also be pot-shaped and have at least one step projecting radially outwards on the side facing away from the base so that the housing can be inserted into an opening in the holder. Irrespective of whether the housing and the holder are one or more components, the housing preferably contains a linearly displaceable piston to which the piston rod is fixed.

In a further embodiment, a control cam is formed on one of the levers, which compresses the linear damper during a closing movement of the hinge shortly before reaching a closing position and during an opening movement shortly before reaching the maximum opening position. As a result, the linear damper can be used for both closing and opening damping. As an option, the opening damping can also be dispensed with. The control cam is preferably formed on at least one curved web of the lever or hinge part and slides along a pin which rests against the linear damper. The pin can be guided linearly in an elongated hole of the holder, so that the pin is moved linearly via the control cam and the linear damper is pressed together accordingly or can be moved apart. It is also possible to actuate the damper directly through the cam.

For a particularly compact design, the stroke length of the linear damper is designed to be less than 5 mm; in particular, the stroke can be between 3 mm and 4.2 mm. The length of the linear damper is preferably less than 20 mm, in particular less than 18 mm, so that the linear damper only occupies a small construction volume in the side part.

BRIEF DESCRIPTION OF THE DRAWING FIGURES

DETAILED DESCRIPTION OF THE EMBODIMENTS

Figure 1:
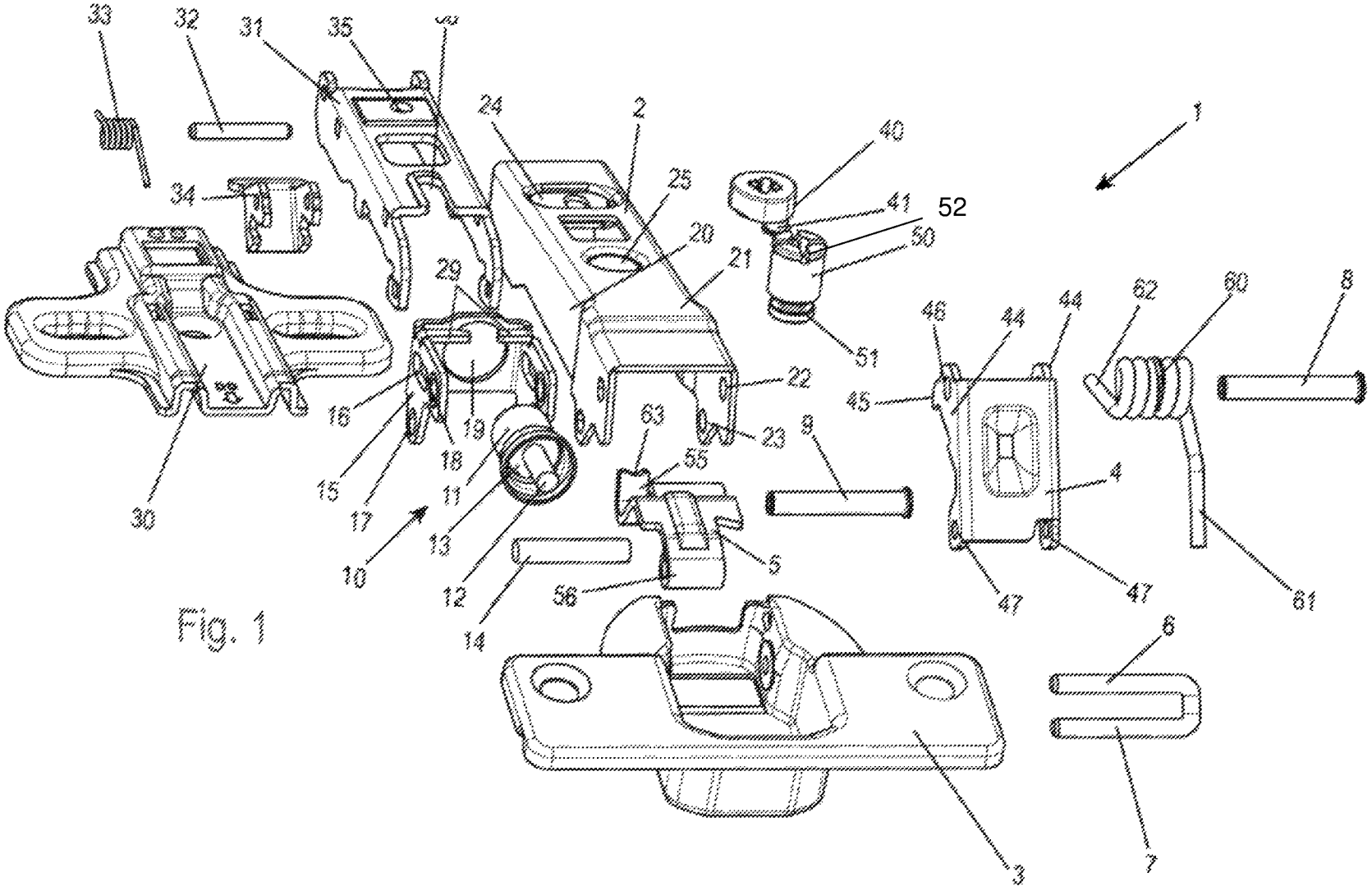
FIG. 1 shows a perspective exploded view of a hinge according to the invention.

A hinge 1, in particular for furniture or household appliances, comprises a side part 2 which can be fixed to a side wall of a furniture body or to another wall. A hinge part 3 is pivotably mounted on the side part 2, on which a door can be fixed, which can be pivoted from a closing position into an opening position via hinge 1. Two levers 4 and 5 are provided between side part 2 and hinge part 3 for this purpose. The lever arm 4 is U-shaped, wherein the lever arm 4 has lateral webs 44. The lever 4 has openings 47 at the webs 44, through which an axis 6 is inserted to rotatably mount the lever 4 on the hinge part 3. Furthermore, a spaced-apart axis 7 is integrally formed with axis 6, which is passed through an eye 56 on the lever 5 to rotatably mount the lever 5 on the hinge part 3. The lever 5 can also consist of several individual flat parts which are placed next to each other to form a lever 5 with corresponding holes for the axes 7 and 9.

The side part 2, which is U-shaped and has two legs 20 and a connecting web 21, has openings 22 on the legs 20, through which the axis 8 is passed, in order to rotatably mount the lever 4 on the side part 2. In addition, openings 23 are formed on the legs 20, through which an axis 9 is inserted in order to rotatably mount the lever 5 on the side part 2.

To dampen a closing movement of hinge part 3, a linear damper 10 is provided, which has a pot-shaped housing 11 and a piston rod 12 movable relative to the housing 11. A piston 13 is fixed to the piston rod 12 to generate damping forces when the piston 13 moves relative to the housing 11. The linear damper 10 has a compact design and the stroke movement of the piston rod 12 is preferably in a range between 2 mm and 6 mm, in particular 3 mm to 5 mm.

The linear damper 10 is fixed to a holder 15, which is arranged in the side part 2. The holder 15 is U-shaped and comprises an opening 19 at the connecting section, into which the housing 11 of the linear damper is inserted, until a radially outwardly projecting edge rests against the housing 11 at the holder 15. Two lugs 29 are formed on the holder to limit movement of the housing 11 in the longitudinal direction of the piston rod 12. The holder 15 has openings 17 and 18 on the two legs which are penetrated by two axes 8 and 9 which are inserted into the side part 2. Thus the holder 15 and thus also the linear damper 10 are non-rotatably held in the side part 2. The holder 15 also includes an elongated hole 16 for guiding a pin 14. The pin 14 rests on one end of the piston rod 12 to compress the linear damper 10. The pin 14 can also be firmly connected to the piston rod 12, so that a kind of hammer head is formed on the piston rod 12 to guide the piston rod 12 in the elongated hole 16. A spring 75 is also provided in the linear damper 10 to pretension the piston rod 12 into a protruding position.

Side part 2 can optionally be fixed directly to a side wall of a furniture body. In the embodiment example shown, however, a mounting plate 30 is fixed to the side wall, on which a retaining element 31 is held, on which the side part 2 is adjustably held. The retaining element 31 has a slot-shaped opening 36 for a height adjustment 50 and an opening 35 for a depth adjustment 40. The depth adjustment 40 has an eccentric pin 41, which is passed through a recess 24 on the side part 2 and engages in the opening 35. The height adjustment 50 has a guide groove 51 which is inserted in the opening 36 on the retaining element 31 and a thread 52 which is engaged by means of the threaded hole 25 in the side part 2.

The retaining element 31 is also latched to the mounting plate 30 via a latching element 34, which is rotatably mounted on the retaining element 31 via an axis 32 and is also pretensioned via a spring 33.

The hinge 1 also comprises a spring 60, which is designed as a leg spring and has a first spring arm 61 supported by the lever 4. A second opposing spring arm 62 is supported on the lever 5, for which a receptacle 63 is formed on a web 55 on the lever 5. Alternatively, other closing spring arrangements known from the state of the art can also be used. For example, arrangements with a leaf spring can also be used.

Figure 2:
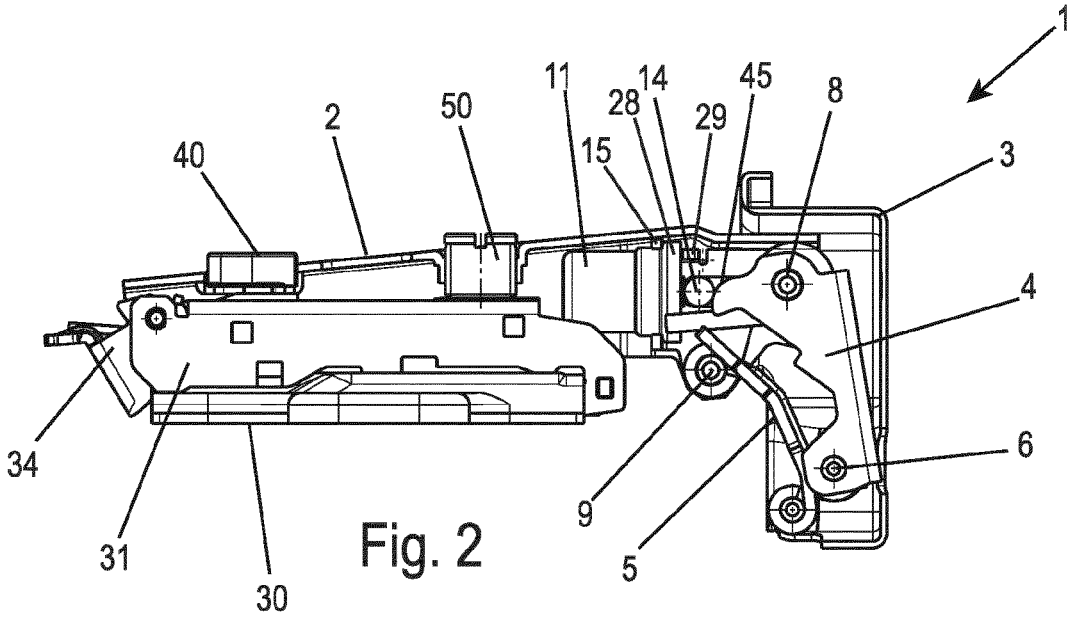
FIG. 2 shows a sectional side view of the hinge of FIG. 1 in a closed position.
Figure 3:
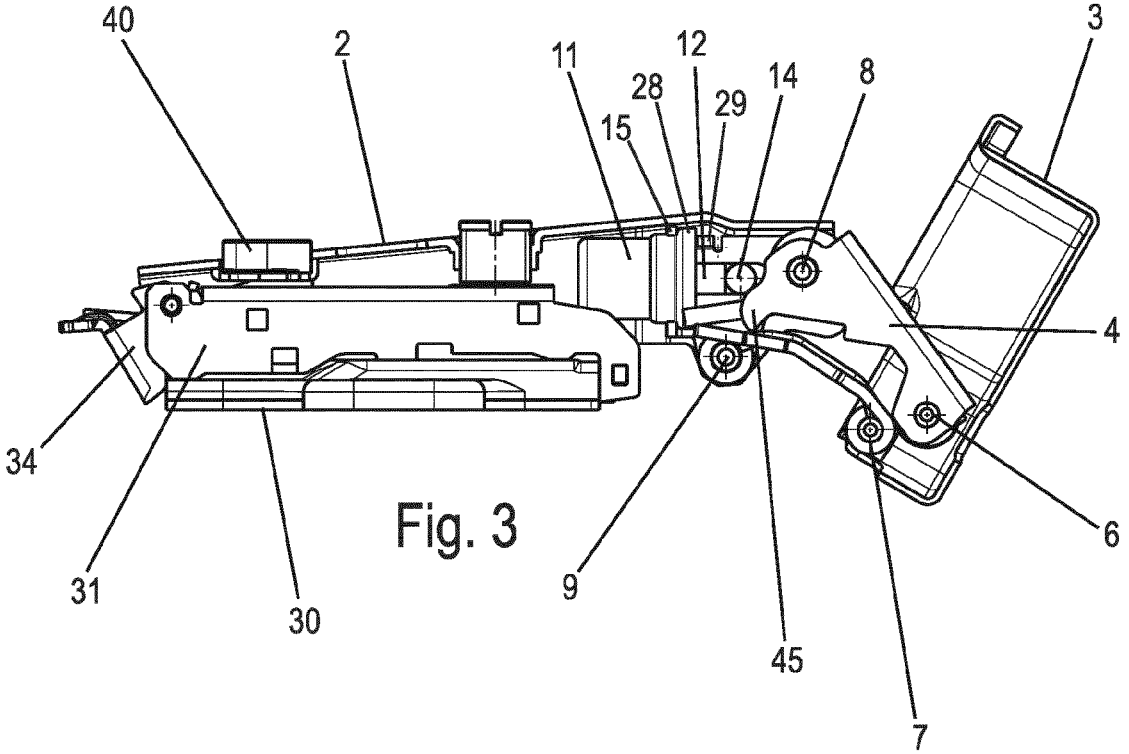
FIGS. 3 and 4 show two views of the hinge of FIG. 2 in middle opening positions.

FIG. 2 shows hinge 1 in an assembled position, wherein hinge part 3 is in a closed position. If hinge part 3 is now pivoted in the opening direction as shown in FIG. 3, levers 4 and 5 also pivot. By pivoting the lever 4, control cam 45 is rotated about axis 8, causing pin 14 to slide along control cam 45. When moving in the opening direction, the longitudinal extension of the linear damper 10 is increased and the piston rod 12 moves out of the housing 11.

Figure 4:
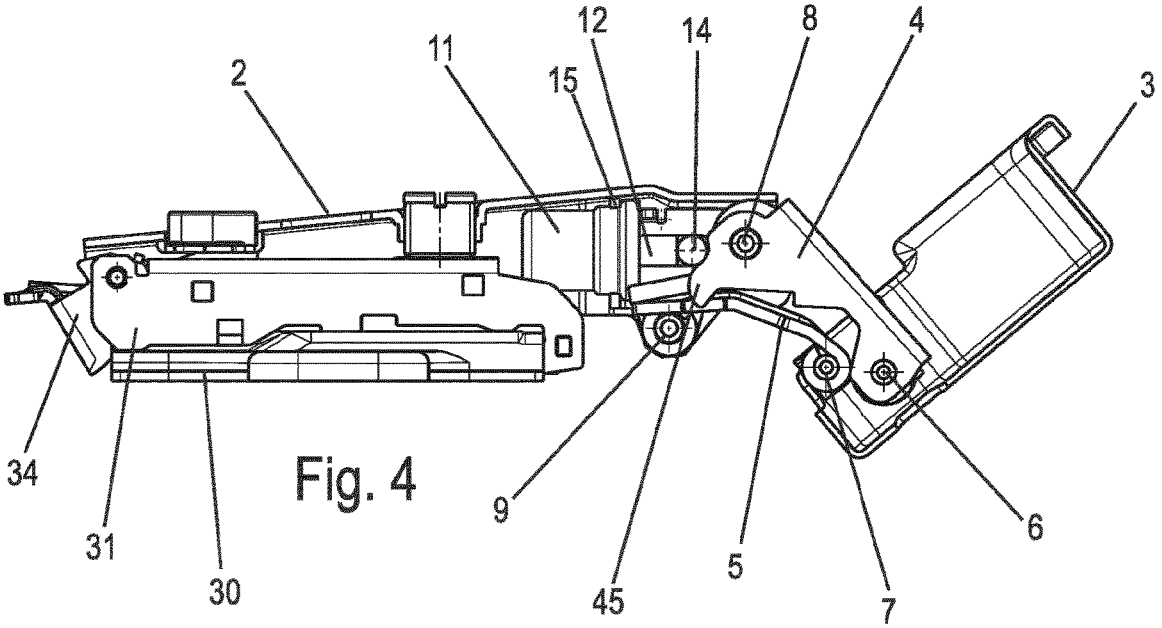
Figure 5:
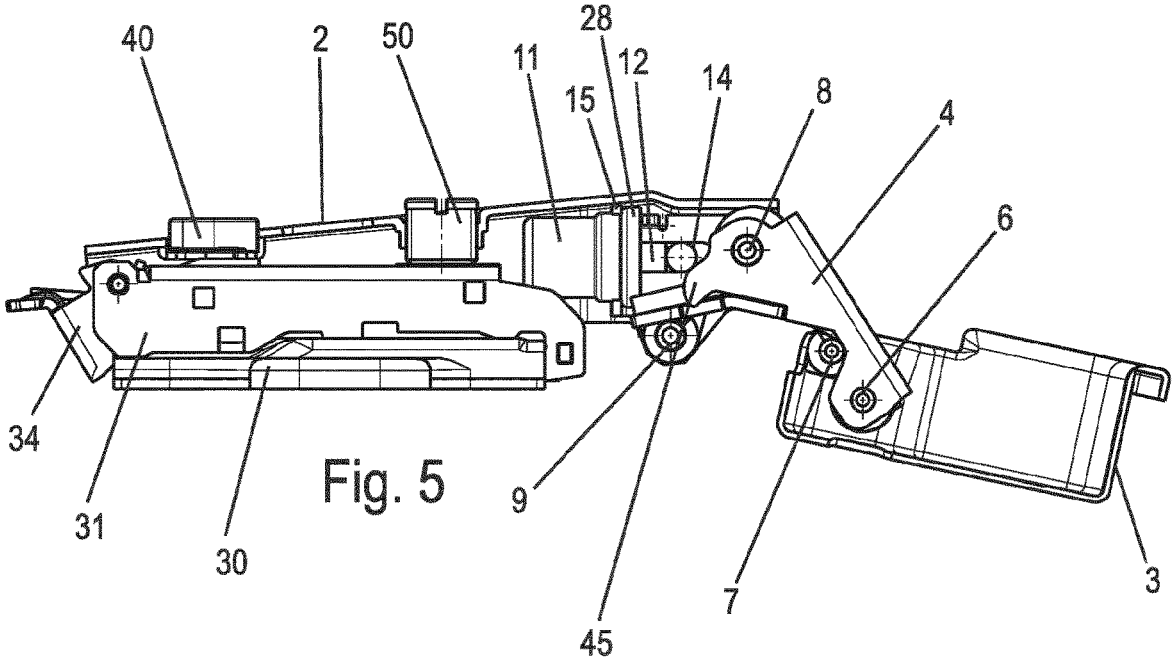
FIG. 5 shows a view of the hinge of FIG. 2 in a maximum opening position.

FIG. 4 shows a middle opening position, in an angle range between 40° and 65°, in which the linear damper experiences its maximum longitudinal extension. Pin 14 rests in a receptacle against the control cam 45 and the piston rod 12 is in the maximum protruding position. If the hinge part 3 now moves further in the opening direction, the lever 4 pivots again in the opposite direction, and the pin 14 slides back again along the control cam 45. This slightly compresses the linear damper by retracting the piston rod 12 until it reaches the position shown in FIG. 5. In this position it can be recognized how the lever 4 with its webs 44 engages over the lever 5. In the maximum opening position, the linear damper has a significantly longer longitudinal extension than in the closing position. Other control cams 45 can also be used to control the linear damper; for example, the linear damper 10 can also be more strongly retracted in the maximum opening position, especially if a stronger opening damping is to be achieved shortly before reaching the maximum opening position. The control cam can also be designed so that the piston rod is retracted in the maximum opening position, but the stroke of the piston rod over the angular range from the maximum longitudinal extension of the damper to the maximum opening position of hinge part 3 is so small or the stroke movement of the piston rod 12 so slow that almost no damping effect occurs. In any case, the linear damper will run through a maximum longitudinal extension during an opening movement of the hinge part 3. In the closing direction, the hinge part 3 is moved from the position shown in FIG. 5 back to the position shown in FIG. 2, wherein the linear damper also passes through a maximum longitudinal extension in this case and is strongly compressed before reaching the closing position, which leads to the necessary damping forces. By interposing a pin 14 between the control cam 45 and the piston rod 12, transverse forces are avoided, since the pin 14 is guided linearly at the elongated hole 16 of the holder 15.

Figure 6:
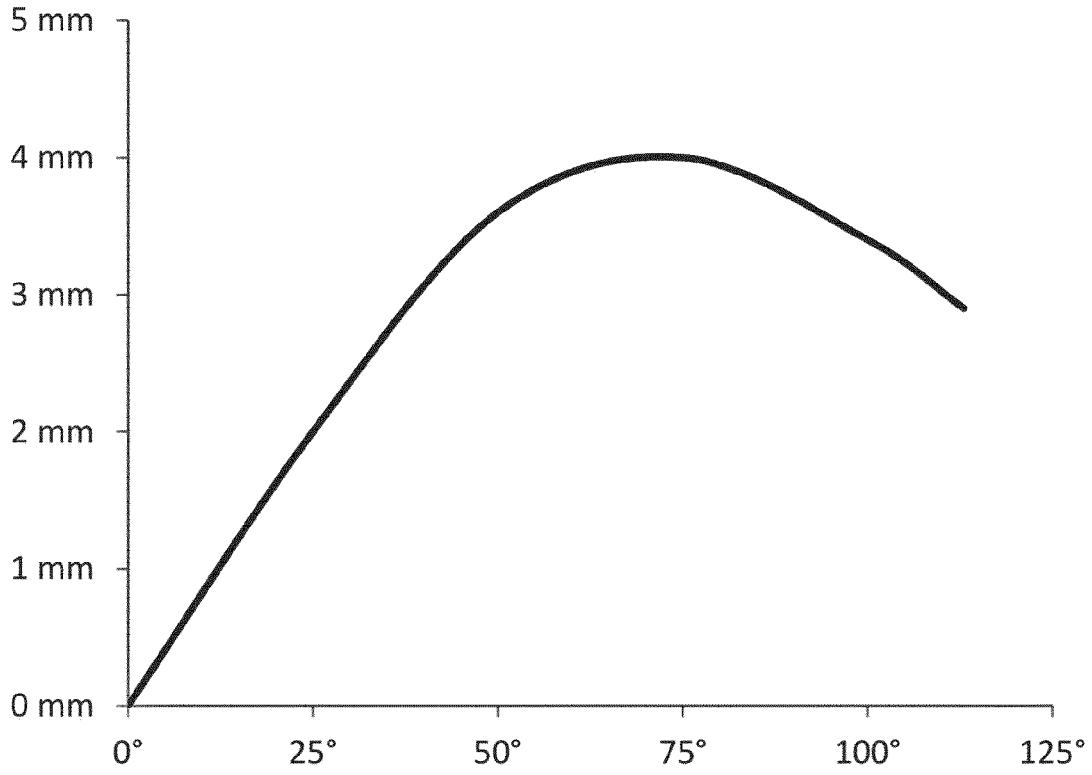
FIG. 6 shows a diagram for illustrating the longitudinal extension of the damper in relation to the opening position of the hinge part.

FIG. 6 shows a diagram in which the position of the piston rod is represented by a stroke movement relative to the opening angle of hinge part 3. It can be seen that in the closed position the piston rod 12 is in the retracted position and that during an opening movement the maximum longitudinal extension of the linear damper is in an angle range between 50 and 75°. If the hinge part 3 reaches a maximum opening position of about 105°, the linear damper is slightly compressed again, wherein lower or no damping forces can act on the hinge part 3 during the pivoting movement up to the maximum opening position. If the hinge part 3 is moved in the closing direction, the damping forces begin to act at an angle between 25 and 40° before the closing position in order to brake hinge part 3. However, hinge part 3 is automatically moved to the closing position via spring 60.

Figure 7:
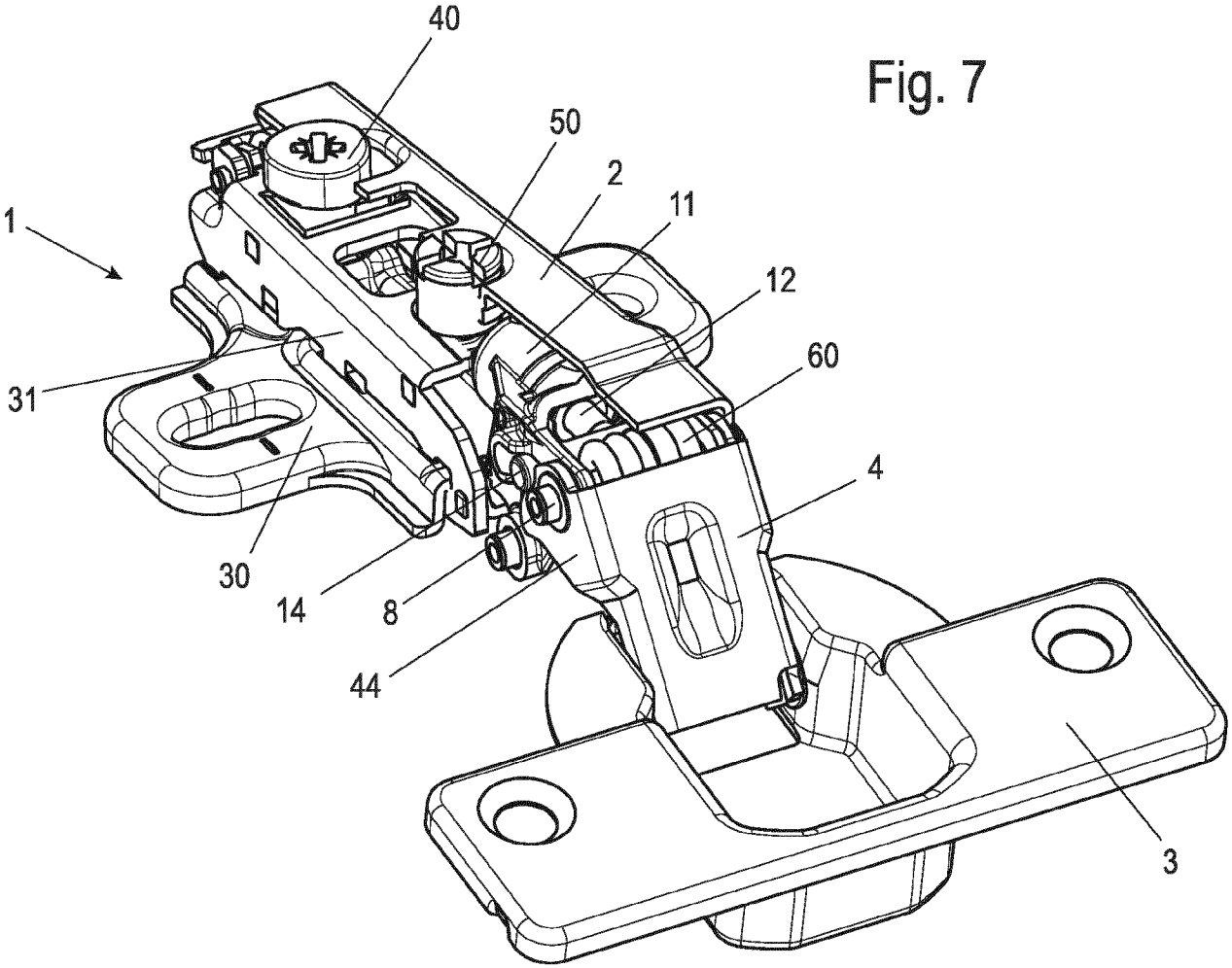
FIG. 7 shows a partially sectional perspective view of the hinge of FIG. 1 with mounted holder.

In FIG. 7, hinge 1 is shown once again in the mounted position, and it can be seen that the housing 11' of the linear damper is accommodated in side part 2 and occupies only a small construction volume. The housing 11' is arranged between the height adjustment 50 and the axes 8 and 9, wherein the extension of the linear damper in the longitudinal direction of the piston rod 12 is preferably smaller than 20 mm, in particular smaller than 18 mm. Despite this small extension, sufficiently high damping forces can be provided.

Figure 8A:
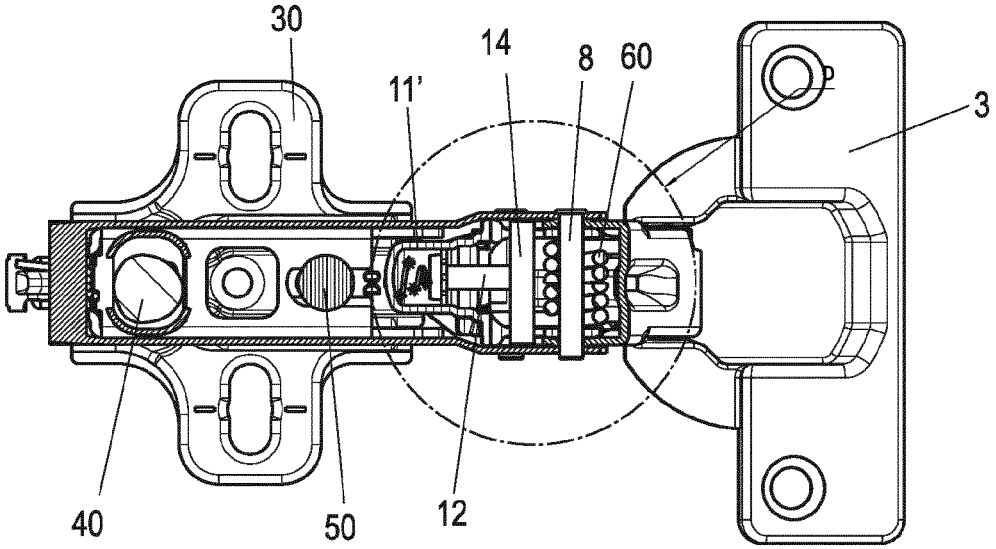
FIG. 8A shows a top view of the hinge with section through the holder with linear damper.
Figure 8B:
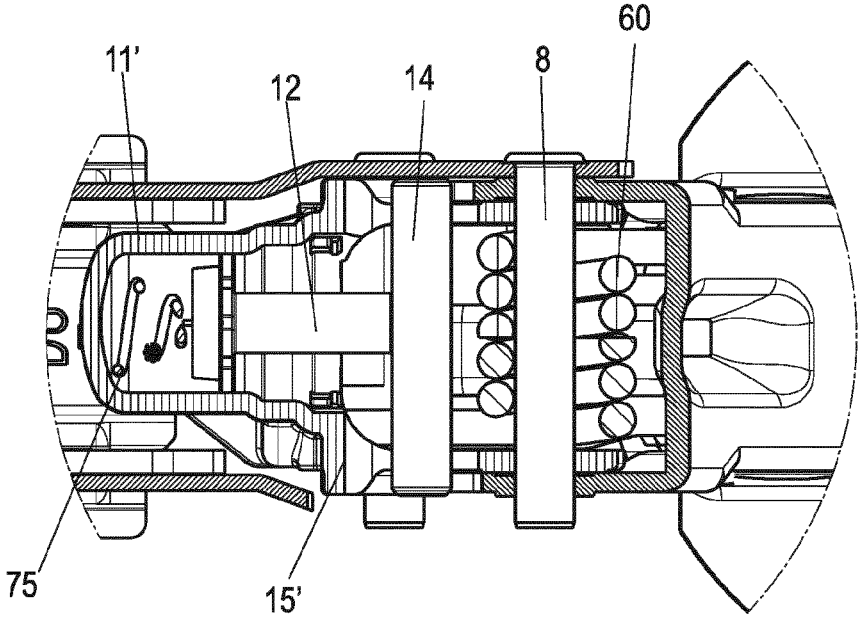
FIG. 8B shows a detailed view of the section from FIG. 8A on holder and linear damper.

FIGS. 8A and 8B show the drive mechanism for moving the piston rod 12 and the positioning of the holder 15' of the linear damper. The piston rod 12 is driven by the pin 14, which rests against one end of the piston rod 12 and is aligned perpendicular to the piston rod 12. The pin 14 is guided through the elongated hole 16 in the holder 15' and can push the piston rod 12 into the pot-shaped housing 11' to generate damping forces.

The spring 60 is held by the axis 8 in an intermediate space of the holder 15', here in the integral construction with the housing 11'. For a compact design and in order to enable moving the spring arm 62 freely past the housing 11', the housing 11' of the damper is formed off-center on the holder 15'. The spring arm 62 can thus extend in a free space thereby created next to the housing 11'.

Figure 9:
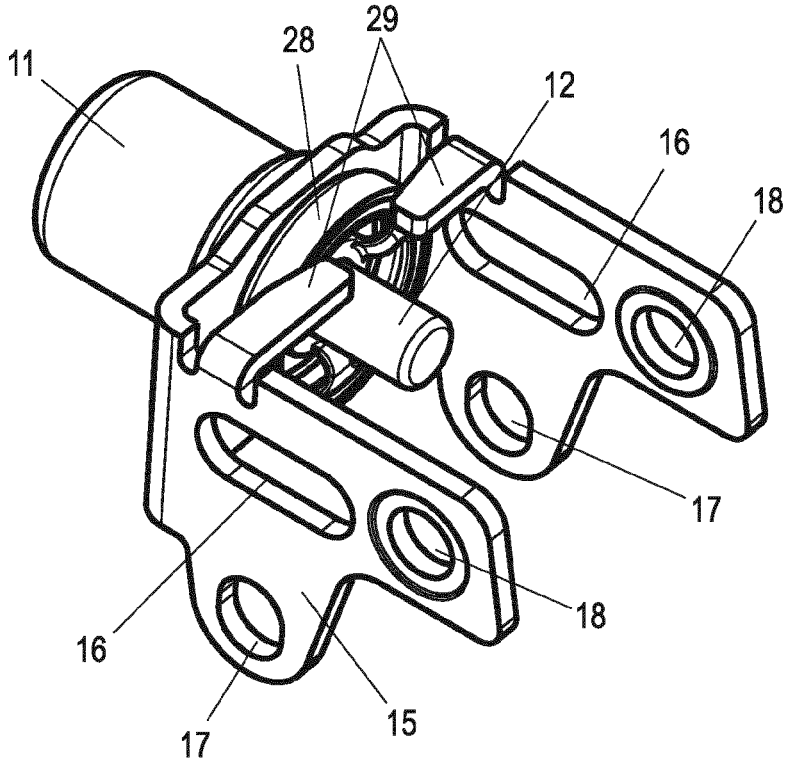
FIG. 9 shows a perspective view of the linear damper fixed to the holder.

FIG. 9 shows the linear damper with the pot-shaped housing 11 and the holder 15. The holder 15 is designed as a U-shaped shaped part, with an elongated hole 16 for guiding the pin 14 formed on each of the two legs of the holder 15. Furthermore, the holder 15 is provided on both legs with openings 17 and 18, which are passed through by the axes 8 and 9, so that the holder is fixed to the side part 2 via the axes 8 and 9, which also pass through the openings 22 and 23 on the side part 2. The holder 15 is thus fixed rigidly to the side part 2, and the linear damper is also non-rotatably fixed to the holder 15, and only the piston rod 12 can move linearly relative to the holder 15. Alternatively, it would of course be possible to fix the piston rod 12 to the holder 15 and only move the housing 11 linearly.

In order to fix the housing 11 in the direction of movement of the piston rod 12, two integrally formed lugs 29 are provided on the holder 15, which form a stop for one edge of the pot-shaped housing 11. The housing 11 has a radially outwardly projecting step 28 at the end opposite the base, which ensures that the housing 11 can be inserted through the opening 19 in the holder 15, but only up to step 28. On the opposite side of the step 28, the lugs 29 are provided, which limit or prevent movement towards the hinge part 3.

Figure 10:
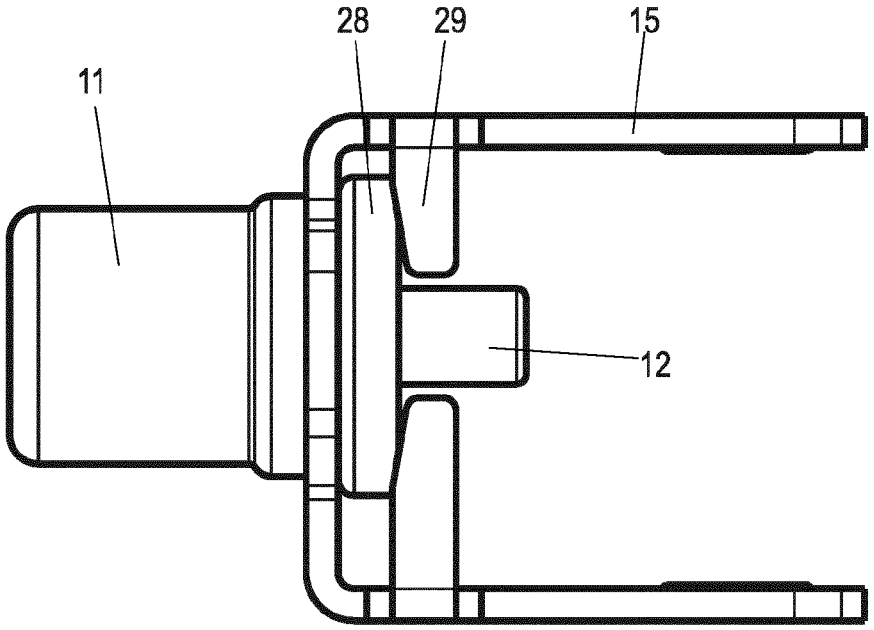
FIG. 10 shows a top view of the holder of FIG. 9.
Figure 11:
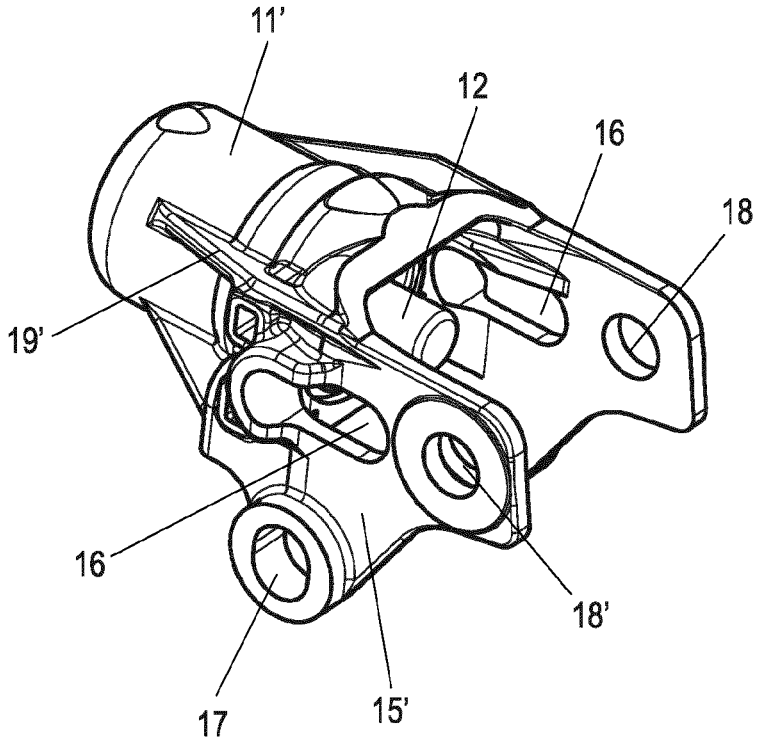
FIG. 11 shows a perspective view of a modified embodiment example of an integral holder with an integrally attached housing.

In FIGS. 9 and 10, the housing 11 and the holder 15 are made of two different parts. In the modified embodiment example shown in FIG. 11, a pot-shaped housing 11' is integrally formed with the holder 15', for example as a molded part made of plastic by an injection molding process. The holder 15' again comprises two plate-shaped legs on which openings 17 and 18 are formed for the insertion of axes 8 and 9. In addition, an elongated hole 16 is provided on both legs to guide the pin 14, so that the unit consisting of housing 11' and holder 15' can be inserted into the side part 2 of the hinge as in the previous example. In order to be able to absorb high forces in the longitudinal direction of the piston rod 12, the pot-shaped housing 11' is connected to the integrally formed holder 15' via reinforcing ribs 19'.

Figure 12:
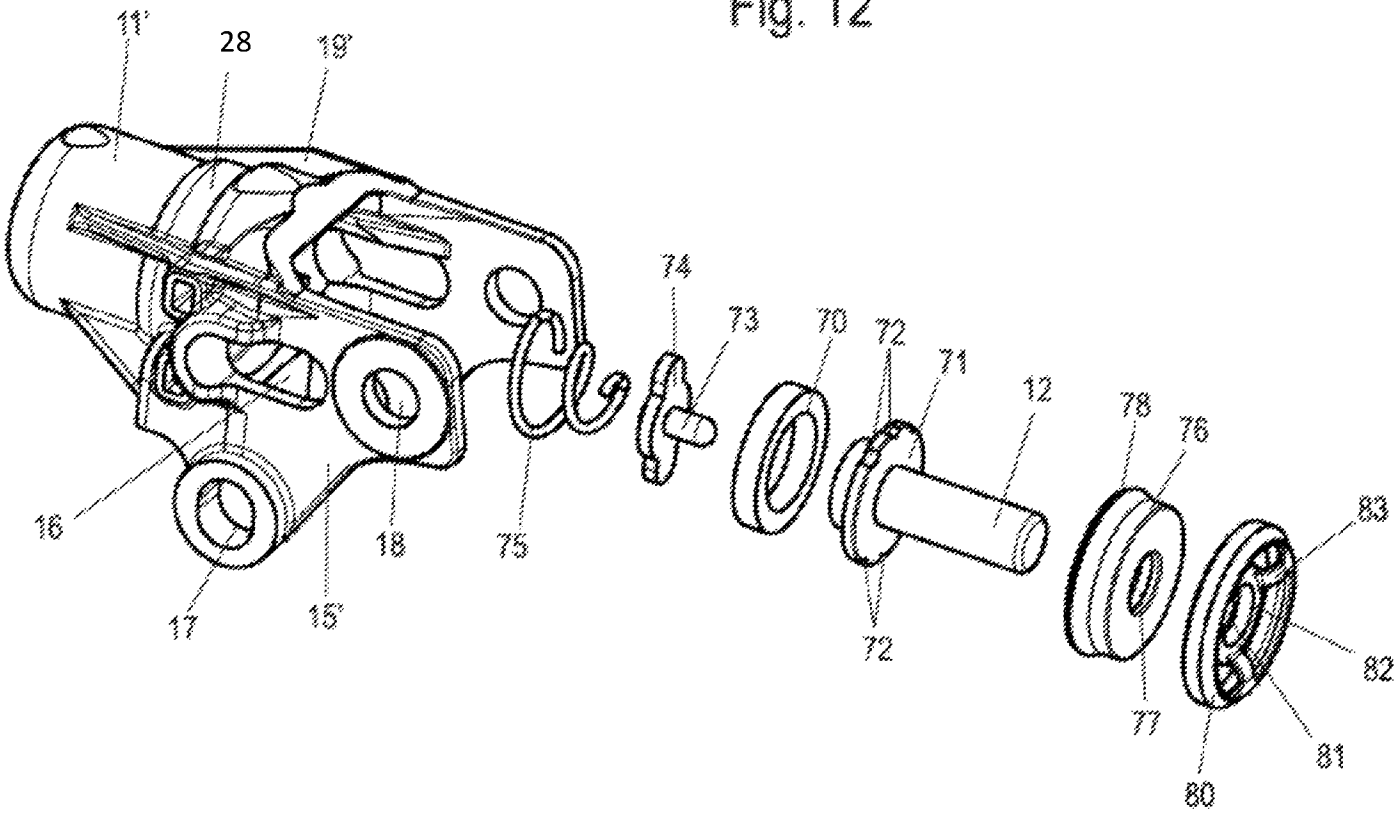
FIG. 12 shows a perspective exploded view of the holder with the linear damper of FIG. 11.

FIG. 12 shows an exploded view of the linear damper. A disk-shaped holder 71 is formed on the piston rod 12, which has several throttle openings 72 at the circumference, through which the flow passes when the piston rod 12 moves in the housing 11'. A piston ring 70 is arranged between the disk-shaped holder 71 and a fixing element 74, in particular with little axial play, wherein the fixing element 74 is fixed to an opening of the piston rod 12 via a pin 73. The axial play of the piston ring 70 ensures that the extension movement of the piston rod 12 can take place relatively smoothly, while pressing the piston rod 12 into the housing 11' leads to high damping forces due to the small flow cross-sections. The piston and the piston rod 12 are pretensioned into the extended position by a spring 75, wherein the spring 75 is supported on one side at the base of the housing 11' and on the opposite side at the fixing element 74.

A seal 76 is also held to the pot-shaped housing at step 28, which is in contact with an outer sealing lip 78 or a sealing bead at an inner wall of step 28. Seal 76 also has an internal opening 77 which is penetrated by the piston rod 12 so that the piston rod 12 is movable relative to seal 76.

The seal 76 is held by a cover 80, which is fixed in a clamped manner to the inner wall of step 28 by an outer ring. The cover 80 includes an inner ring 82 with an opening 81 penetrated by the piston rod 12. The inner ring 82 is mounted in a spring-loaded manner via spring elements 83 in the axial direction of the piston rod 12 and presses the seal 76 into the housing 11'. If the piston rod 12 is moved into the housing 11', the piston rod 12 displaces a certain volume, so that a damping fluid, for example oil, requires more volume. As a result, the seal 76 is slightly displaced in the axial direction on the housing 11' against the force of the spring elements 83, so that the volume of the piston rod 12 can be compensated. When the piston rod 12 is pushed out of the housing 11' again by the spring 75, volume compensation takes place in the opposite direction and the seal 76 is pushed back into the housing 11' by the spring elements 83. Of course, other pistons fixed to piston rods 12 can also be used as linear dampers. The linear damper with the housing 11 or 11' and the piston rod 12 preferably has a length of less than 20 mm, in particular less than 18 mm, so that a particularly compact design is provided.

LIST OF REFERENCE NUMERALS

1 Hinge
2 Side part
3 Hinge part
4 Lever
5 Lever
6 Axis
7 Axis
8 Axis
9 Axis
10 Linear damper
11, 11' Housing
12 Piston rod
13 Piston
14 Pin
15, 15' Holder
16 Elongated hole
17 Opening
18 Opening
19 Opening
19' Reinforcing rib
20 Leg
21 Connecting web
22 Opening
23 Opening
24 Recess
25 Threaded hole
28, 28' Step
29 Lug
30 Mounting plate
31 Retaining element
32 Axis
33 Spring
34 Latching element
35 Opening
36 Opening
40 Depth adjustment
41 Pin
44 Web
45 Control cam
47 Opening
50 Height adjustment

51 Guide groove
52 Thread
55 Web
56 Eye
60 Spring
61 Spring arm
62 Spring arm
63 Receptacle
70 Piston ring
71 Holder
72 Throttle opening
73 Pin
74 Fixing element
75 Spring
76 Seal
77 Opening
78 Sealing lip
80 Cover
81 Opening
82 Ring
82 Spring element

What is claimed is:

1. A hinge (1) having a side part (2) which is configured to be fixed to a wall and a hinge part (3) which is configured to be pivoted relative to the side part (2) and to which a door can be fixed, and having a linear damper (10) which is arranged in the side part (3) and has a housing (11, 11') and a piston rod (12), which is pretensioned by a spring (75), and which is compressed during an opening or closing of the hinge part (3) wherein the housing (11, 11') of the linear damper (10) is non-rotatably fixed in the side part (2) via a holder (15) to at least one axis (8, 9) on which a lever (4, 5) is mounted for pivotably mounting the hinge part (3), wherein the housing (11) of the linear damper (10) is of pot-shaped design and wherein at least one step (28) projecting radially outwards is formed on a side facing away from a base, and the housing (11) is inserted into an opening (19) of the holder (15).

2. The hinge according to claim 1, wherein the at least one axis comprises two axes and wherein the holder (15, 15') has a U-shaped shaped part which has openings (17, 18) on two legs, through each of which one of the axes (8, 9) passes.

3. The hinge according to claim 1, wherein a linearly displaceable piston which is fixed to the piston rod (12) is arranged in the housing (11, 11').

4. The hinge according to claim 1, wherein a control cam (45) is formed on the lever (4) for mounting the hinge part (3), which cam compresses the linear damper (10) during an opening movement of the hinge part before reaching a maximum opening position.

5. The hinge according to claim 1, wherein a length of the stroke of the linear damper (10) is less than 5 mm.

6. The hinge according to claim 1, wherein a length of the linear damper (10) is less than 20 mm.

7. The hinge according to claim 1, wherein one of the at least one axis (8, 9) carries a spring for supporting the closing of the hinge, wherein the spring is located in an intermediate space of the holder (15, 15').

8. The hinge according to claim 7, wherein a spring arm (61) of the spring (60) extends in a free space adjacent the housing (11, 11').

9. The hinge according to claim 1, wherein the side part (2) is adjustably held on a mounting plate (30) and a retaining element (31), wherein the side part (2) is adjustable relative to the mounting plate (30) via a height adjustment (50) and a depth adjustment (40).

10. The hinge according claim 1, A hinge (1) having a side part (2) which is configured to be fixed to a wall and a hinge part (3) which is configured to be pivoted relative to the side part (2) and to which a door can be fixed, and having a linear damper (10) which is arranged in the side part (3) and has a housing (11, 11') and a piston rod (12), which is pretensioned by a spring (75), wherein the housing (11, 11') of the linear damper (10) is non-rotatably fixed in the side part (2) via a holder (15) to at least one axis (8, 9) on which a lever (4, 5) is mounted for pivotably mounting the hinge part (3), wherein a control cam (45) is formed on the lever (4) for mounting the hinge part (3), which cam compresses the linear damper (10) during a closing movement of the hinge part before reaching a closed position, and wherein the control cam (45) is formed on at least one bent web and slides along a pin which rests against the piston rod (12) of the linear damper (10).

11. The hinge according to claim 10, wherein the housing (11') is formed integrally with the holder (15').

12. The hinge according to claim 10, wherein the pin (14) is linearly guided in an elongated hole (16) on the holder (15).

* * * * *